US011062827B2

(12) United States Patent
Ding et al.

(10) Patent No.: US 11,062,827 B2
(45) Date of Patent: Jul. 13, 2021

(54) SINTERED MAGNET COMPOSITION WITHOUT HEAVY RARE EARTH ELEMENT AND A METHOD OF MAKING THE SINTERED MAGNET

(71) Applicant: Yantai Shougang Magnetic Materials, Inc., Yantai (CN)

(72) Inventors: Kaihong Ding, Yantai (CN); Zhongjie Peng, Yantai (CN); Guohai Wang, Yantai (CN); Xiulei Chen, Yantai (CN)

(73) Assignee: YANTAI SHOUGANG MAGNETIC MATERIALS INC., Yantai (CN)

( * ) Notice: Subject to any disclaimer, the term of this patent is extended or adjusted under 35 U.S.C. 154(b) by 800 days.

(21) Appl. No.: 15/401,349

(22) Filed: Jan. 9, 2017

(65) Prior Publication Data

US 2017/0213627 A1 Jul. 27, 2017

(30) Foreign Application Priority Data

Jan. 21, 2016 (CN) ..... 201610039324.5

(51) Int. Cl.
*H01F 41/02* (2006.01)
*B22F 3/16* (2006.01)
(Continued)

(52) U.S. Cl.
CPC ..... *H01F 1/0577* (2013.01); *B22D 11/001* (2013.01); *B22F 1/0059* (2013.01);
(Continued)

(58) Field of Classification Search
CPC ..... B22F 3/10; B22F 2003/10
See application file for complete search history.

(56) References Cited

U.S. PATENT DOCUMENTS

2006/0201585 A1* 9/2006 Tomizawa ..... C22C 33/0278 148/302
2007/0221296 A1* 9/2007 Enokido ..... C22C 1/0441 148/301
(Continued)

FOREIGN PATENT DOCUMENTS

CN 101982855 A 3/2011
CN 102982935 A 3/2013
(Continued)

OTHER PUBLICATIONS

JP Search and English Translation dated Dec. 21, 2017 (18 Pages).

*Primary Examiner* — Vanessa T. Luk
(74) *Attorney, Agent, or Firm* — William H. Honaker; Dickinson Wright PLLC

(57) ABSTRACT

A method of making a rare earth magnet containing zero heavy rare earth elements includes a step of mixing the fine grain powder with the lubricant having a weight content of at least 0.03 wt. % and no greater than 0.2 wt. % for a period of between 1 and 2 hours. The step of pulverizing is further defined as jet milling the alloy powder with the lubricant using a carrier gas of argon or nitrogen. The method further includes a step of controlling oxygen content during the steps of melting, forming, disintegrating, mixing, pulverizing, molding, and sintering whereby the impurities including Carbon (C), Oxygen (O), and Nitrogen (N) satisfies $1.2C+0.6O+N \leq 2800$ ppm. A rare earth magnet composition including C, O, and N whereby C, O, and N satisfies $1.2C+0.6O+N \leq 2800$ ppm and has zero heavy rare earth elements.

6 Claims, 2 Drawing Sheets

(51) Int. Cl.

| | |
|---|---|
| ***H01F 1/057*** | (2006.01) |
| ***B22D 11/00*** | (2006.01) |
| ***B22F 1/00*** | (2006.01) |
| ***B22F 3/24*** | (2006.01) |
| ***B22F 9/04*** | (2006.01) |
| ***C21D 6/00*** | (2006.01) |
| ***C21D 9/00*** | (2006.01) |
| ***C22C 38/00*** | (2006.01) |
| ***C22C 38/06*** | (2006.01) |
| ***C22C 38/10*** | (2006.01) |
| ***C22C 38/16*** | (2006.01) |
| ***H01F 1/058*** | (2006.01) |
| ***H01F 1/059*** | (2006.01) |

(52) U.S. Cl.

CPC ..... *B22F 3/16* (2013.01); *B22F 3/24* (2013.01); *B22F 9/04* (2013.01); *C21D 6/007* (2013.01); *C21D 9/0068* (2013.01); *C22C 38/002* (2013.01); *C22C 38/005* (2013.01); *C22C 38/06* (2013.01); *C22C 38/10* (2013.01); *C22C 38/16* (2013.01); *H01F 1/058* (2013.01); *H01F 1/059* (2013.01); *H01F 41/0253* (2013.01); *H01F 41/0266* (2013.01); *B22F 2003/248* (2013.01); *B22F 2009/044* (2013.01); *B22F 2201/013* (2013.01); *B22F 2201/02* (2013.01); *B22F 2201/11* (2013.01); *B22F 2201/20* (2013.01); *B22F 2202/05* (2013.01); *B22F 2304/10* (2013.01); *B22F 2998/10* (2013.01); *B22F 2999/00* (2013.01)

(56) References Cited

U.S. PATENT DOCUMENTS

| | | | | |
|---|---|---|---|---|
| 2015/0023831 | A1 | 1/2015 | Lin et al. | |
| 2015/0348685 | A1* | 12/2015 | Hu ..... | C22C 38/16 75/246 |
| 2016/0307676 | A1 | 10/2016 | Deng et al. | |

FOREIGN PATENT DOCUMENTS

| | | | | |
|---|---|---|---|---|
| CN | 103377820 | A | | 10/2013 |
| CN | 104143403 | A | * | 11/2014 |
| CN | 104143403 | A | | 11/2014 |
| CN | 104157386 | A | * | 11/2014 |
| CN | 104157386 | A | | 11/2014 |
| CN | 105255782 | A | | 1/2015 |
| CN | 103890867 | A | | 6/2017 |
| JP | 2007134353 | A | | 5/2007 |
| JP | 2014225623 | A | | 12/2014 |
| WO | 2013054842 | A1 | | 4/2013 |
| WO | 2015147053 | A1 | | 10/2015 |

* cited by examiner

SINTERED MAGNET COMPOSITION WITHOUT HEAVY RARE EARTH ELEMENT AND A METHOD OF MAKING THE SINTERED MAGNET

CROSS REFERENCE TO RELATED APPLICATION

This application claims priority to Chinese application serial number CN201610039324.5 filed on Jan. 21, 2016.

BACKGROUND OF THE INVENTION

1. Field of the Invention

The present invention relates generally to a method for preparing a sintered rare earth magnet and a sintered rare earth magnet composition.

2. Description of the Prior Art

Currently, Nd—Fe—B magnets are the best performing permanent magnets and are widely used in the fields of memory equipment, electronic component, wind generator, and motors. However, because the Nd—Fe—B magnets have a high temperature coefficient, under a high temperature, magnetic properties of the Nd—Fe—B magnets deteriorate which lower the performance of the magnet. Magnets that have a lower performance are very difficult in meeting the performance demands of hybrid vehicles and motors.

To improve the working temperature of Nd—Fe—B magnet, commonly used methods include increasing the Curie temperature of the magnet, increasing the magnetic anisotropy field of the magnet, or increasing the coercive force of the magnet. The Curie temperature and the magnetocrystalline anisotropy are directly related to the intrinsic properties of the materials. In other words, the Curie temperature and the magnetocrystalline anisotropy are depended on the material composition of the magnet. On the other hand, traditional methods of increasing the coercive force typically results in a reduction of magnetic energy values (BH)m. Currently, the most effective way of increasing the coercive force is to introduce heavy rare earth elements such as Dysprosium (Dy) and Terbium (Tb) to replace the Neodymium (Nd) in the main phase of $Nd_2Fe_{14}B$. The $Nd_2Fe_{14}B$ magnets have a magnetocrystalline anisotropy constant of 5600 KA/m, the $Dy_2Fe_{14}B$ magnets have a magnetocrystalline anisotropy constant of 12000 KA/M, and the $Tb_2Fe_{14}B$ magnets have a magnetocrystalline anisotropy constant of 176000 KA/m. Accordingly, the replacement of Nd with a heavy rare earth element such as Dy or Tb leads to an increase in the coercive force. However, the heavy rare earth elements are scarce and expensive which increase the cost of making the magnets. To decrease the usage of the heavy rare earth elements, grain boundary diffusion technology is introduced. However, because the depth of the diffusion is limited, the grain boundary diffusion method can only be used to produce thin layered magnets. One such method is disclosed in Chinese Patent CN102280240B which includes a sputtering-depositing method to manufacture a magnet that has a low Dy content but with good magnetic performance. However, such a method is too complicated and is difficult to control the distribution of Dy in the magnet.

In addition, the Chinese Patent CN102280240B discloses a rare earth magnet composition including at least one rare earth element being present between 8 at. % and 14 at. % and selected from a group consisting of Scandium (Sc), Lanthanum (La), Cerium (Ce), Praseodymium (Pr), Neodymium (Nd), Promethium (Pm), Samarium (Sm), Europium (Eu) and Gadolinium (Gd). The rare earth magnet composition also includes boron (B) being present between 5.5 at. % and 7.0 at. %. The rare earth magnet composition further includes at least one additive being present between 2.0 at. % and 5.0 at. % and is selected from a group consisting of Aluminum (Al), Cobalt (Co), Copper (Cu), and Gallium (Ga). Iron (Fe) is present in the rare earth magnet composition as a balance.

U.S. Patent Application US2002/0017338 discloses a method of making a rare earth magnet. The method includes a step of preparing a raw powder having a composition including at least one rare earth element being present between 8 at. % and 30 at. %, Boron (B) being present between 2 at. % and 28 at. %, at least one additive being present between 0.1 at. % and 1 wt. %, iron (Fe) being present as a balance, and impurities of Carbon (C) and Oxygen (O) and Nitrogen (N). The method also includes a step of melting the raw powder to produce a molten alloy. The next step of the method is forming the molten alloy into an alloy sheet. The method further includes a step of disintegrating the alloy sheet by subjecting the alloy sheet in a hydrogen atmosphere in a hydrogen decrepitation process to expand and break-up the alloy sheet and produce an alloy powder. The step of disintegrating further includes a step of degassing hydrogen. Then, the alloy powder is mixed with a lubricant having a weight content of at least 0.05 wt. % and no more than 0.5 wt. %. Next, the alloy powder with the lubricant is pulverized to produce a fine grain powder having an average particle size between 2.0 μm and 6.0 μm. The next step of the method is molding the fine grain powder into a compact. The step of molding further includes a step of orienting the fine grain powder under a magnetic field of between 2.0 T and 2.5 T. Finally, the compact is sintered under a vacuum to produce a magnet.

SUMMARY OF THE INVENTION

The invention provides for such a method including a step of mixing the fine grain power with the lubricant having a weight content of at least 0.03 wt. % and no greater than 0.2 wt. %.

The invention provides for a rare earth magnet composition whereby the composition includes zero heavy rare earth elements selected from a group consisting of Yttrium (Y), Terbium (Tb), Dysprosium (Dy), Holmium (Ho), Erbium (Er), Thulium (Tm), Ytterbium (Yb), and Lutetium (Lu) and the Carbon (C), the Oxygen (O), and the Nitrogen (N) satisfies $1.2C+0.6O+N \leq 2800$ ppm.

Advantages of the Invention

The invention in its broadest aspect provides a method of manufacturing a sintered rare earth magnet with improved magnetic properties without the addition of any heavy rare earth elements.

The invention further provides a rare earth magnet that is low in material cost and contains zero heavy rare earth elements.

BRIEF DESCRIPTION OF THE DRAWINGS

Other advantages of the present invention will be readily appreciated, as the same becomes better understood by reference to the following detailed description when considered in connection with the accompanying drawings wherein.

DESCRIPTION OF THE ENABLING EMBODIMENT

Figure 1:
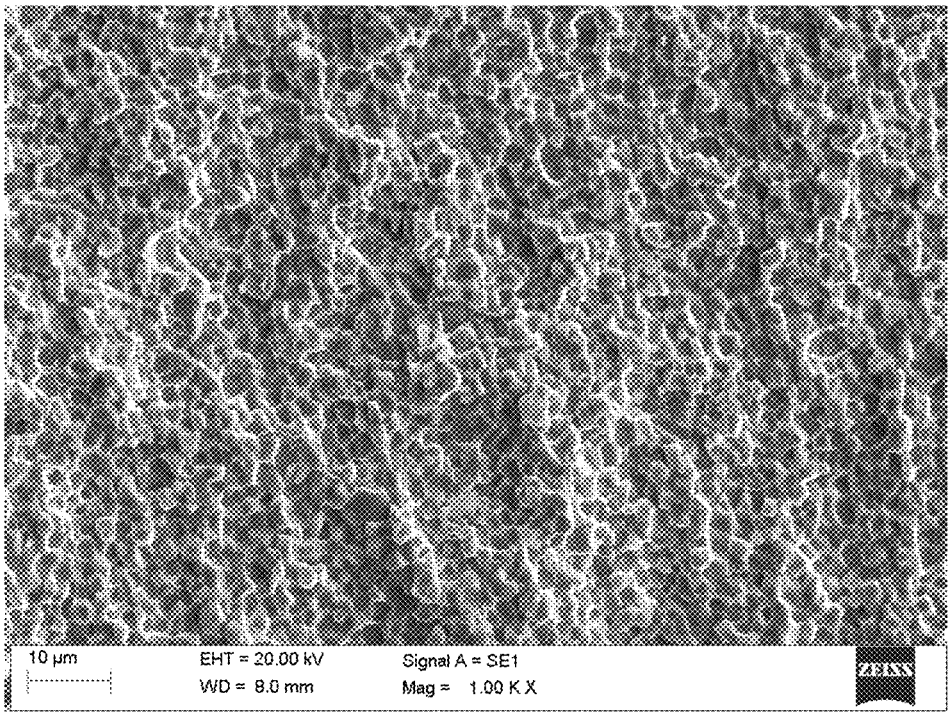
FIG. 1 is a Scanning Electron Microscopy Image of a magnet produced in Implementing Example 1.

Referring to the Figures, it is one aspect of the present invention to provide a method for preparing a sintered rare earth magnet. The method includes a first step of preparing a raw powder. The raw powder includes at least one rare earth element being present between 31 wt. % and 34 wt. % and selected from a group consisting of Scandium (Sc), Lanthanum (La), Cerium (Ce), Praseodymium (Pr), Neodymium (Nd), Promethium (Pm), Samarium (Sm), Europium (Eu) and Gadolinium (Gd). The raw powder also includes Boron (B) being present between 0.8 wt. % and 1.2 wt. %. In addition, the raw powder includes at least one additive being present between 1.3 wt. % and 2.9 wt. % and selected from a group consisting of Aluminum (Al), Cobalt (Co), Copper (Cu), and Gallium (Ga). The Aluminum (Al) is present between 0.4 wt. % and 0.8. wt. %. The Cobalt (Co) is present between 0.6 wt. % and 1.2 wt. %. The Copper (Cu) is present between 0.2 wt. % and 0.5 wt. %. The Gallium (Ga) is present between 0.1 wt. % and 0.4 wt. %. Iron (Fe) is present as a balance. Furthermore, the raw power includes impurities of Carbon (C), Oxygen (O), and Nitrogen (N). Lastly, the raw powder includes zero heavy rare earth elements selected from a group consisting of Yttrium (Y), Terbium (Tb), Dysprosium (Dy), Holmium (Ho), Erbium (Er), Thulium (Tm), Ytterbium (Yb), and Lutetium (Lu), The method also includes a step of melting the raw powder to produce a molten alloy. The molten alloy is then formed into an alloy sheet. The step of forming is further defined as thin strip casting the raw powder to form the alloy sheet having a uniform thickness of between 0.1 mm to 0.6 mm. The method also includes a step of disintegrating the alloy sheet by subjecting the alloy sheet in a hydrogen atmosphere in a hydrogen decrepitation process to expand and break-up the alloy sheet and produce an alloy powder. The step of disintegrating is further defined as subjecting the alloy sheet in the hydrogen atmosphere in a hydrogen decrepitation process under a predetermined pressure of between 0.15 MPa and 0.3 MPa and for a duration of 3.5 hours. The step of disintegrating further includes a step of degassing the hydrogen. The step of degassing the hydrogen is further defined as removing the hydrogen at a predetermined temperature of 550° C.

The method further includes a step of mixing the alloy powder with a lubricant having a weight content of at least 0.05 wt. % and no more than 0.5 wt. %. In addition, the method includes a step of pulverizing the alloy powder with the lubricant to produce a fine grain powder having an average particle size between 2.0 μm and 3.0 μm. The step of pulverizing is further defined as jet milling the alloy powder with the lubricant using a carrier gas of argon to produce the fine grain powder. Alternatively, instead of using Argon, the step of pulverizing may be further defined as jet milling the alloy powder with the lubricant using a carrier gas of nitrogen to produce the fine grain powder.

The fine grain powder is then molded into a compact. The step of molding further includes a step of orienting the fine grain powder under a magnetic field of between 2.0 T and 2.5 T. The method includes another step of sintering the compact under a vacuum to produce a magnet. The step of sintering is further defined as sintering the compact under the vacuum of no more than $5\times10^{-2}$ Pa, at a sintering temperature of between 880° C. and 1030° C., and for a first time extent of between 6 hours and 15 hours. The step of sintering further includes a step of cooling the compact from the sintering temperature to room temperature of approximately 21° C. Next, the compact is heated from the room temperature to a first annealing temperature of between 780° C. and 860° C. The step of sintering further includes a step of maintaining the compact at the first annealing temperature of between 760° C. and 860° C. for a second time extent of 3 hours and under the vacuum of no more than $5\times10^{-2}$ Pa. The step of sintering further includes a step of cooling the compact from the first annealing temperature to the room temperature of 21° C. Then, the compact is heated from the room temperature to a second annealing temperature of between 480° C. and 550° C. The step of sintering further including a step of maintaining the compact at the second annealing temperature for a third time extent of between 2 hours and 8 hours and under the vacuum of no more than $5\times10^{-2}$ Pa.

The method includes a step of mixing the fine grain power with the lubricant having a weight content of at least 0.03 wt. % and no greater than 0.2 wt. % for a period of between 1 hour and 2 hours. Typically, decreasing the particle size to the fine grain powder of the magnet and improving the distribution of rich-Nd phase are effective ways to increase the coercive force of the magnet. However, the fine gain powder is difficult to pulverize, mold, and sinter because the fine grain powder can be easily oxidized and azotized. In addition, during the step of sintering, the fine grain powder may have abnormal grain growth. By mixing the fine grain powder with the lubricant having the weight content of at least 0.03 wt. % and no greater than 0.2 wt. %, the lubricant prevents the grain powder from oxidized and azotized. The method further includes a step of controlling oxygen content during the step of melting, the step of forming, the step of disintegrating, the steps of mixing, the step of pulverizing, the step of molding, and the step of sintering whereby the impurities including the Carbon (C) and the Oxygen (O) and the Nitrogen (N) satisfies $1.2C+0.6O+N\leq2800$ ppm. By controlling the oxygen content and limit the impurities of the Carbon (C), the Oxygen (O), and the Nitrogen (N) to satisfy $1.2C+0.6O+N\leq2800$ ppm, the microstructure and the magnetic properties of the magnet are improved.

It is another aspect of the present invention to provide a sintered rare earth magnet composition. The sintered rare earth magnet composition includes at least one rare earth element being present between 31 wt. % and 34 wt. %. The at least one rare earth element is selected from a group consisting of Scandium (Sc), Lanthanum (La), Cerium (Ce), Praseodymium (Pr), Neodymium (Nd), Promethium (Pm), Samarium (Sm), Europium (Eu), and Gadolinium (Gd). Most preferably, the at least one rare earth element includes Praseodymium (Pr) and Neodymium (Nd). The composition also includes Boron (B) being present between 0.8 wt. % and 1.2 wt. %. The composition further includes at least one additive being present between 1.3 wt. % and 2.9 wt. %. The at least one additive is selected from a group consisting of Aluminum (Al), Cobalt (Co), Copper (Cu), and Gallium (Ga). More preferably, the at least one additive includes Aluminum (Al), Cobalt (Co), Copper (Cu), and Gallium (Ga) whereby the Aluminum (Al) is present between 0.4 wt. % and 0.8 wt. %, the Cobalt (Co) is present between 0.6 wt. % and 1.2 wt. %, the Copper (Cu) is present between 0.2 wt. % and 0.5 wt. %, and the Gallium (Ga) is present between 0.1 wt. % and 0.4 wt. %. Iron (Fe) is present in the composition as a balance.

The composition includes impurities of Carbon (C), Oxygen (O), and Nitrogen (N) whereby the Carbon (C), the Oxygen (O), and Nitrogen (N) satisfies $1.2C+0.6O+N \leq 2800$ ppm. The composition includes zero heavy rare earth elements selected from a group consisting of Yttrium (Y), Terbium (Tb), Dysprosium (Dy), Holmium (Ho), Erbium (Er), Thulium (Tm), Ytterbium (Yb), and Lutetium (Lu).

To have a better understanding of the present invention, the examples set forth below provide illustrations of the present invention. The examples are only used to illustrate the present invention and do not limit the scope of the present invention.

Implementing Example 1

A raw powder including Nd—Pr being present 32.5 wt. %, B being present 0.8 wt. %, Al being present 0.4 wt. %, Co being present 0.7 wt. %, Cu being present 0.3 wt. %, Ga being present 0.2 wt. %, and Fe being present as a balance. The raw powder is then melted to produce a molten alloy. Next, the molten alloy is then formed into an alloy sheet having a uniform thickness of between 0.1 mm to 0.6 mm using a thin strip casting process. Then, then alloy sheet is disintegrated to produce an alloy powder. The step of disintegrating is further defined as subjecting the alloy sheet in a hydrogen atmosphere in a hydrogen decrepitation process under a predetermined pressure of between 0.2 MPa for a duration of 3.5 hours. The step of disintegrating further includes a step of degassing the hydrogen at a predetermined temperature of 550° C.

The alloy powder is then mixed with a lubricant having a weight content of 0.1 wt. %. Next, the alloy powder with the lubricant is pulverized by subjecting the alloy powder to a jet milling process using a carrier gas of Nitrogen to produce a fine grain powder having an average particle size of 2.8 μm. Then, the fine grain power is mixed with the lubricant having a weight content of 0.05 wt. % using a blender mixer for a period of 2 hours. The fine grain powder is then molded into a compact. The step of molding also includes orienting the fine grain powder under a magnetic field of between 2.0 T. Finally, the compact is sintered under a vacuum of no more than $5\times10^{-2}$ Pa and at a sintering temperature of 920° C. for a first time extent of 6 hours. Next, the compact is cooled from the sintering temperature to room temperature. Then, the compact is heated from the room temperature to a first annealing temperature of 850° C. The first annealing temperature is maintained for 3 hours and under the vacuum of no more than $5\times10^{-2}$ Pa. Next, the compact is cooled from the first annealing temperature to the room temperature. Then, the compact is heated from the room temperature to a second annealing temperature of 525° C. The second annealing temperature is maintained for 2 hours and under the vacuum of no more than $5\times10^{-2}$ Pa.

Figure 3:
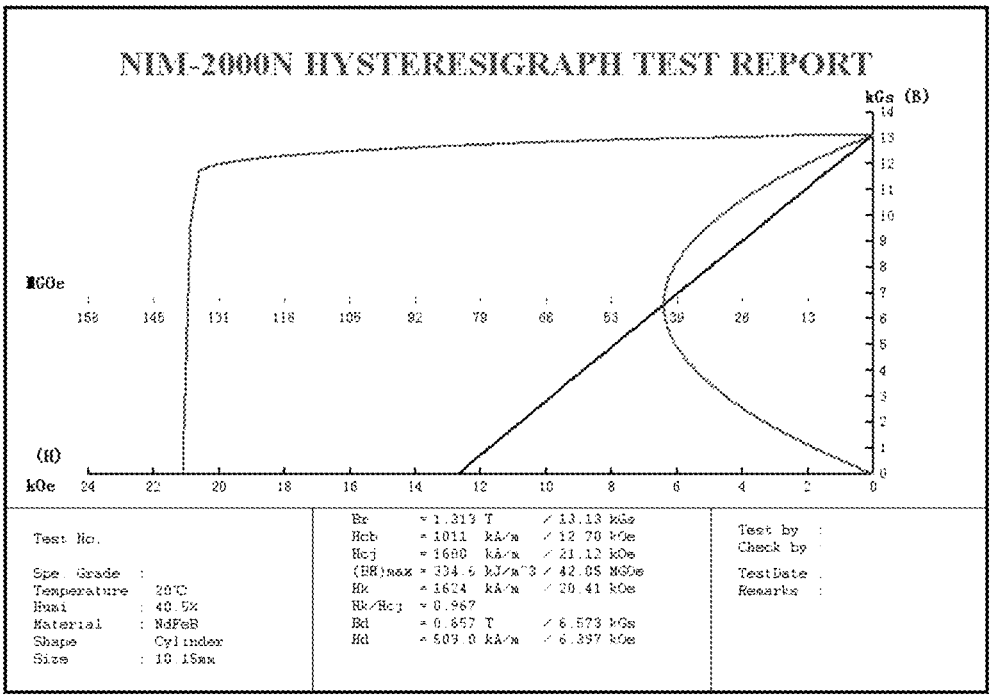
FIG. 3 is a B-H graph of the magnet produced in the Implementing Example 1.

The oxygen content is controlled throughout the process including the step of melting, the step of forming, the step of disintegrating, the steps of mixing, the step of pulverizing, the step of molding, and the step of sintering whereby the impurities including C, O and N satisfies $1.2C+0.6O+N=1702$ ppm. The magnet produced in Implementing Example 1 contains zero heavy rare earth magnets selected from a group consisting of Y, Tb, Dy, Ho, Er, Tm, Yb, and Lu. A scanning electron microscope image of the magnet is shown in FIG. 1 and a B-H curve of the magnet is shown in FIG. 3. Majority of the grain size of the magnet ranges from 2.1 μm to 4.3 μm. The Hcj of the magnet is approximately 1680 kA/m at room temperature, Br value of the magnet is 1.313 T, and the maximum BH of the magnet is 334.6 kJ/m$^3$. The magnetic properties for the magnet are set forth in Table 1 below.

Implementing Example 2

A raw powder including Nd—Pr being present 33 wt. %, B being present 0.9 wt. %, Al being present 0.6 wt. %, Co being present 0.7 wt. %, Cu being present 0.4 wt. %, Ga being present 0.15 wt. %, and Fe being present as a balance. The raw powder is then melted to produce a molten alloy. Next, the molten alloy is then formed into an alloy sheet having a uniform thickness of between 0.1 mm to 0.6 mm using a thin strip casting process. Then, then alloy sheet is disintegrated to produce an alloy powder. The step of disintegrating is further defined as subjecting the alloy sheet in a hydrogen atmosphere in a hydrogen decrepitation process under a predetermined pressure of between 0.2 MPa for a duration of 3.5 hours. The step of disintegrating further includes a step of degassing the hydrogen at a predetermined temperature of 550° C.

The alloy powder is then mixed with a conventional lubricant having a weight content of 0.1 wt. %. Next, the alloy powder with the lubricant is pulverized by subjecting the alloy powder to a jet milling process to produce a fine grain powder having an average particle size of 2.3 μm. Then, the fine grain power is mixed with the lubricant having a weight content of 0.05 wt. % using a blender mixer for a period of 2 hours. The fine grain powder is then molded into a compact. The step of molding also includes orienting the fine grain powder under a magnetic field of between 2.0 T. Finally, the compact is sintered under a vacuum of no more than $5\times10^{-2}$ Pa and at a sintering temperature of 900° C. for a first time extent of 10 hours. Next, the compact is cooled from the sintering temperature to room temperature. Then, the compact is heated to from the room temperature to a first annealing temperature of 850° C. The first annealing temperature is maintained for 3 hours and under the vacuum of no more than $5\times10^{-2}$ Pa. Next, the compact is cooled from the first annealing temperature to the room temperature. Then, the compact is heated to a second annealing temperature of 525° C. The second annealing temperature is maintained for 2 hours and under the vacuum of no more than $5\times10^{-2}$ Pa.

The oxygen content is controlled throughout the process including the step of melting, the step of forming, the step of disintegrating, the steps of mixing, the step of pulverizing, the step of molding, and the step of sintering whereby the impurities including C, O, and N satisfies $1.2C+0.6O+N=2800$ ppm. The magnet produced in Implementing Example 2 contains zero heavy rare earth magnets selected from a group consisting of Y, Tb, Dy, Ho, Er, Tm, Yb, and Lu. Majority of the grain size of the magnet ranges from 2.0 μm to 4.2 μm. The Hcj value of the magnet is approximately 1680 kA/m at room temperature, Br value of the magnet is 1.306 T, and the maximum BH of the magnet is 330.8 kJ/m$^3$. The magnetic properties for the magnet are set forth in Table 1 below.

Implementing Example 3

A raw powder including Nd—Pr being present 34 wt. %, B being present 0.8 wt. %, Al being present 0.4 wt. %, Co being present 0.6 wt. %, Cu being present 0.5 wt. %, Ga being present 0.4 wt. %, and Fe being present as a balance. The raw powder is then melted to produce a molten alloy. Next, the molten alloy is then formed into an alloy sheet having a uniform thickness of between 0.1 mm to 0.6 mm using a thin strip casting process. Then, then alloy sheet is disintegrated to produce an alloy powder. The step of disintegrating is further defined as subjecting the alloy sheet in a hydrogen atmosphere in a hydrogen decrepitation process under a predetermined pressure of between 0.15 MPa for a duration of 3.5 hours. The step of disintegrating further includes a step of degassing the hydrogen at a predetermined temperature of 550° C.

The alloy powder is then mixed with a conventional lubricant having a weight content of 0.05 wt. %. Next, the alloy powder with the lubricant is pulverized by subjecting the alloy powder to a jet milling process using a carrier gas of Nitrogen to produce a fine grain powder having an average particle size of 2.0 μm. Then, the fine grain power is mixed with the lubricant having a weight content of 0.2 wt. % using a blender mixer for a period of 2 hours. The fine grain powder is then molded into a compact. The step of molding also includes orienting the fine grain powder under a magnetic field of between 2.0 T. Finally, the compact is sintered under a vacuum of no more than $5\times10^{-2}$ Pa and at a sintering temperature of 880° C. for a first time extent of 15 hours. Next, the compact is cooled from the sintering temperature to room temperature. Then, the compact is heated to a first annealing temperature of 780° C. The first annealing temperature is maintained for 3 hours and under the vacuum of no more than $5\times10^{-2}$ Pa. Next, the compact is cooled from the first annealing temperature to the room temperature. Then, the compact is heated from the room temperature to a second annealing temperature of 480° C. The second annealing temperature is maintained for 8 hours and under the vacuum of no more than $5\times10^{-2}$ Pa.

The oxygen content is controlled throughout the process including the step of melting, the step of forming, the step of disintegrating, the steps of mixing, the step of pulverizing, the step of molding, and the step of sintering whereby the impurities including C, O, and N satisfies 1.2C+0.6O+N=2200 ppm. The magnet produced in Implementing Example 3 contains zero heavy rare earth magnets selected from a group consisting of Y, Tb, Dy, Ho, Er, Tm, Yb, and Lu. Majority of the grain size of the magnet ranges from 1.8 μm to 3.9 μm. The Hcj value of the magnet is approximately 1724 kA/m at room temperature, Br value of the magnet is 1.296 T, and the maximum BH of the magnet is 316.1 kJ/m$^3$. The magnetic properties for the magnet are set forth in Table 1 below.

Implementing Example 4

A raw powder including Nd—Pr being present 31 wt. %, B being present 1.2 wt. %, Al being present 0.8 wt. %, Co being present 1.2 wt. %, Cu being present 0.2 wt. %, Ga being present 0.1 wt. %, and Fe being present as a balance. The raw powder is then melted to produce a molten alloy. Next, the molten alloy is then formed into an alloy sheet having a uniform thickness of between 0.1 mm to 0.6 mm using a thin strip casting process. Then, then alloy sheet is disintegrated to produce an alloy powder. The step of disintegrating is further defined as subjecting the alloy sheet in a hydrogen atmosphere in a hydrogen decrepitation process under a predetermined pressure of between 0.3 MPa for a duration of 3.5 hours. The step of disintegrating further includes a step of degassing the hydrogen at a predetermined temperature of 550° C.

The alloy powder is then mixed with a conventional lubricant having a weight content of 0.5 wt. %. Next, the alloy powder with the lubricant is pulverized by subjecting the alloy powder to a jet milling process using a carrier gas of Argon to produce a fine grain powder having an average particle size of 3.0 μm. Then, the fine grain power is mixed with the lubricant having a weight content of 0.03 wt. % using a blender mixer for a period of 1 hours. The fine grain powder is then molded into a compact. The step of molding also includes orienting the fine grain powder under a magnetic field of between 2.5 T. Finally, the compact is sintered under a vacuum of no more than $5\times10^{-2}$ Pa and at a sintering temperature of 1030° C. for a first time extent of 6 hours. Next, the compact is cooled from the sintering temperature to room temperature. Then, the compact is heated from the room temperature to a first annealing temperature of 860° C. The first annealing temperature is maintained for 3 hours and under the vacuum of no more than $5\times10^{-2}$ Pa. Next, the compact is cooled from the first annealing temperature to the room temperature. Then, the compact is heated from the room temperature to a second annealing temperature of 550° C. The second annealing temperature is maintained for 3 hours and under the vacuum of no more than $5\times10^{-2}$ Pa.

The oxygen content is controlled throughout the process including the step of melting, the step of forming, the step of disintegrating, the steps of mixing, the step of pulverizing, the step of molding, and the step of sintering whereby the impurities including C, O, and N satisfies 1.2C+0.6O+N=1681 ppm. The magnet produced in Implementing Example 4 contains zero heavy rare earth magnets selected from a group consisting of Y, Tb, Dy, Ho, Er, Tm, Yb, and Lu. Majority of the grain size of the magnet ranges from 2.8 μm to 5.3 μm. The Hcj value of the magnet is approximately 1503 kA/m at room temperature, Br value of the magnet is 1.308 T, and the maximum BH of the magnet is 334.2 kJ/m$^3$. The magnetic properties for the magnet are set forth in Table 1 below.

Comparative Example 1

A raw powder including Nd—Pr being present 29.3 wt. %, Dy being present 2.0 wt. %, B being present 0.9 wt. %, Al being present 0.6 wt. %, Co being present 1.0 wt. %, Cu being present 0.25 wt. %, Ga being present 0.15 wt. %, and Fe being present as a balance. The raw powder is then melted to produce a molten alloy. Next, the molten alloy is then formed into an alloy sheet having a uniform thickness of between 0.1 mm to 0.6 mm using a thin strip casting process. Then, then alloy sheet is disintegrated to produce an alloy powder. The step of disintegrating is further defined as subjecting the alloy sheet in a hydrogen atmosphere in a hydrogen decrepitation process under a predetermined pressure of between 0.2 MPa for a duration of 3.5 hours. The step of disintegrating further includes a step of degassing the hydrogen at a predetermined temperature of 550° C.

The alloy powder is then mixed with a conventional lubricant having a weight content of 0.1 wt. %. Next, the alloy powder with the lubricant is pulverized by subjecting the alloy powder to a jet milling process to produce a fine grain powder having an average particle size of 4.7 μm. Then, the fine grain power is mixed with the lubricant having a weight content of 0.09 wt. % using a blender mixer for a period of 2 hours. The fine grain powder is then molded into a compact. The step of molding also includes orienting the fine grain powder under a magnetic field of between 2.0 T. Finally, the compact is sintered under a vacuum and at a sintering temperature of 1010° C. for a first time extent of 6 hours. Next, the compact is cooled from the sintering temperature to room temperature. Then, the compact is heated from the room temperature to a first annealing temperature of 850° C. The first annealing temperature is maintained for 3 hours and under the vacuum. Next, the compact is cooled from the first annealing temperature to the room temperature. Then, the compact is heated from the room temperature to a second annealing temperature of 525° C. The second annealing temperature is maintained for 2 hours and under the vacuum.

Figure 2:
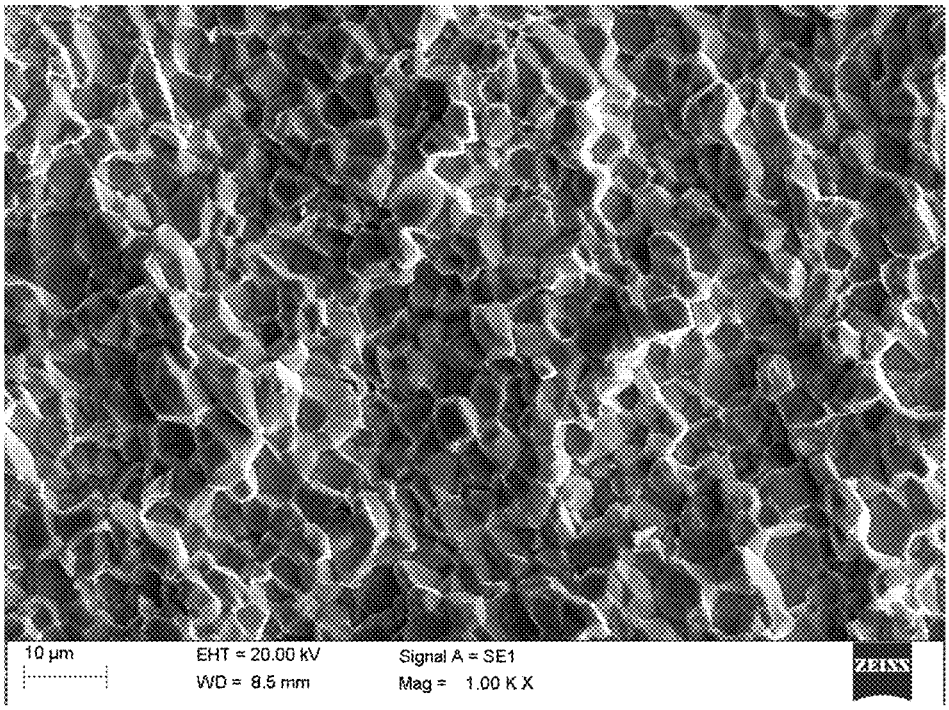
FIG. 2 is a Scanning Electron Microscopy Image of a magnet produced in Comparative Example 1.
Figure 4:
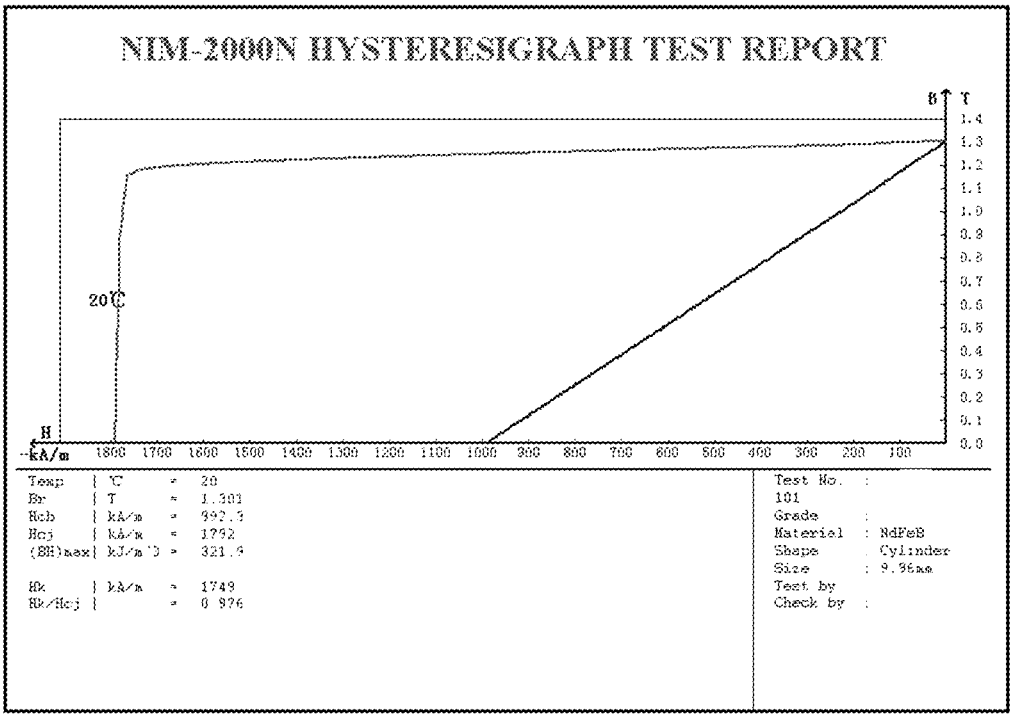
FIG. 4 is a B-H graph of the magnet produced in the Comparative Example 1.

The oxygen content is controlled throughout the process including the step of melting, the step of forming, the step of disintegrating, the steps of mixing, the step of pulverizing, the step of molding, and the step of sintering whereby the impurities including C, O, and N satisfies 1.2C+0.6O+N=1295 ppm. The magnet produced in Comparative Example 1 contains 2.0 wt. % of heavy rare earth magnets of Dy. A scanning electron microscope image of the magnet is shown in FIG. 2 and a B-H curve of the magnet is shown in FIG. 4. Majority of the grain size of the magnet ranges from 4.0 μm to 8.0 μm. The Hcj value of the magnet is approximately 1792 kA/m at room temperature, Br value of the magnet is 1.301 T, and the maximum BH of the magnet is 321.9 kJ/m$^3$. The magnetic properties for the magnet are set forth in Table 1 below.

Comparative Example 2

A raw powder including Nd—Pr being present 27.1 wt. %, Dy being present 4.0 wt. %, B being present 0.9 wt. %, Al being present 0.6 wt. %, Co being present 1.0 wt. %, Cu being present 0.25 wt. %, Ga being present 0.15 wt. %, and iron (Fe) being present as a balance. The raw powder is then melted to produce a molten alloy. Next, the molten alloy is then formed into an alloy sheet having a uniform thickness of between 0.1 mm to 0.6 mm using a thin strip casting process. Then, then alloy sheet is disintegrated to produce an alloy powder. The step of disintegrating is further defined as subjecting the alloy sheet in a hydrogen atmosphere in a hydrogen decrepitation process under a predetermined pressure of between 0.2 MPa for a duration of 3.5 hours. The step of disintegrating further includes a step of degassing the hydrogen at a predetermined temperature of 550° C.

The alloy powder is then mixed with a conventional lubricant having a weight content of 0.1 wt. %. Next, the alloy powder with the lubricant is pulverized by subjecting the alloy powder to a jet milling process using to produce a fine grain powder having an average particle size of 4.7 μm. Then, the fine grain power is mixed with the lubricant having a weight content of 0.09 wt. % using a blender mixer for a period of 2 hours. The fine grain powder is then molded into a compact. The step of molding also includes orienting the fine grain powder under a magnetic field of between 2.0 T. Finally, the compact is sintered under a vacuum and at a sintering temperature of 1010° C. for a first time extent of 6 hours. Next, the compact is cooled from the sintering temperature to room temperature. Then, the compact is heated from the room temperature to a first annealing temperature of 850° C. The first annealing temperature is maintained for 3 hours and under the vacuum. Next, the compact is cooled from the first annealing temperature to the room temperature. Then, the compact is heated from the room temperature to a second annealing temperature of 525° C. The second annealing temperature is maintained for 2 hours and under the vacuum.

The oxygen content is controlled throughout the process including the step of melting, the step of forming, the step of disintegrating, the steps of mixing, the step of pulverizing, the step of molding, and the step of sintering whereby the impurities including C, O, and N satisfies 1.2C+0.6O+N=1555 ppm. The magnet produced in Comparative Example 1 contains 4.0 wt. % of heavy rare earth magnets of Dy. Majority of the grain size of the magnet ranges from 4.0 μm to 8.0 μm. The Hcj value of the magnet is approximately 1894 kA/m at room temperature, Br value of the magnet is 1.310 T, and the maximum BH of the magnet is 325.9 kJ/m$^3$. The magnetic properties for the magnet are set forth in Table 1 below.

TABLE 1

Magnetic Properties of the Magnets produced in the Implementing and the Comparative Examples

| | Br (T) | Hcb (KA/m) | Hcj (KA/m) | Hk/Hcj | (BH)max (KJ/m$^3$) | 1.2C + 0.6O + N (ppm) |
|---|---|---|---|---|---|---|
| Implementing Example 1 | 1.313 | 1012 | 1680 | 0.97 | 334.6 | 1702 |
| Implementing Example 2 | 1.306 | 1005 | 1680 | 0.97 | 330.8 | 2800 |
| Implementing Example 3 | 1.296 | 991.6 | 1724 | 0.90 | 316.1 | 2200 |
| Implementing Example 4 | 1.308 | 1001 | 1503 | 0.95 | 334.2 | 1681 |
| Comparative example 1 | 1.301 | 992.3 | 1792 | 0.98 | 321.9 | 1295 |
| Comparative example 2 | 1.310 | 1001 | 1894 | 0.96 | 325.9 | 1555 |

Table 1 illustrates the magnetic properties of the magnets produced in the Implementing Examples and the Comparative Examples. As shown in Table 1 and the Figures, the magnets produced in the Implementing Examples 1 and 2 include zero heavy rare earth elements. Compared to the Comparative Examples, the particle size in the magnets produced in the Implementing Examples is much smaller and uniform than the magnets produce in the Comparative Examples. The Remanence (Br) for the magnets of both the Implementing Examples and the Comparative Examples are very close relative to one another. With regard to the intrinsic coercive force (Hcj), although the Hcj values for the magnets in the Implementing Examples 1 and 2 including zero heavy rare earth elements and the Hcj values for the magnets in the Comparative Examples 1 and 2, including 2 wt. % and 4 wt. % of heavy rare earth elements, respectively, differs in 103 kA/m and 207 kA/m, respectively, the magnets from the Implementing Examples nevertheless received SH labeling. In other words, the magnets produced in Implementing Examples can operate below a temperature of no more than 150° C. which is the same as the magnets produced in the Comparative Examples. Therefore, it can be concluded that a decrease in the particle size of the fine grain powders can efficiently increase the Hcj of magnet. By pulverizing the alloy powder with the lubricant to produce a fine grain powder having an average particle size between 2.0 μm and 3.0 μm, controlling the amount of lubricant, and controlling the oxygen content in all the manufacturing steps whereby the impurities of C, O, and N satisfies 1.2C+0.6O+N≤2800 PPM, the high magnetic properties of magnet can be obtained without adding any heavy rare earth elements.

Obviously, many modifications and variations of the present invention are possible in light of the above teachings and may be practiced otherwise than as specifically described while within the scope of the appended claims. These antecedent recitations should be interpreted to cover any combination in which the inventive novelty exercises its utility. The use of the word "said" in the apparatus claims refers to an antecedent that is a positive recitation meant to be included in the coverage of the claims whereas the word "the" precedes a word not meant to be included in the coverage of the claims. In addition, the reference numerals in the claims are merely for convenience and are not to be read in any way as limiting.

What is claimed is:

1. A method for preparing a sintered rare earth magnet, said method comprising the steps of:

preparing a raw powder having a composition including Pr and Nd being present in a combined amount of between 31 wt. % and 34 wt. %, boron (B) being present between 0.8 wt. % and 1.2 wt. %, Aluminum (Al) being present between 0.4 wt. % and 0.8 wt. %, Cobalt (Co) being present between 0.6 wt. % and 1.2 wt. %, Copper (Cu) being present between 0.2 wt. % and 0.5 wt. %, Gallium (Ga) being present between 0.1 wt. % and 0.4 wt. %, iron (Fe) being present as a balance, and impurities of Carbon (C) and Oxygen (O) and Nitrogen (N) whereby the raw powder includes zero heavy rare earth elements selected from a group consisting of Yttrium (Y) and Terbium (Tb) and Dysprosium (Dy) and Holmium (Ho) and Erbium (Er) and Thulium (Tm) and Ytterbium (Yb) and Lutetium (Lu);

melting the raw powder to produce a molten alloy;

forming the molten alloy into an alloy sheet;

disintegrating the alloy sheet by subjecting the alloy sheet in a hydrogen atmosphere in a hydrogen decrepitation process to expand and break-up the alloy sheet and produce an alloy powder;

said step of disintegrating further including a step of degassing hydrogen;

mixing the alloy powder with a lubricant having a weight content of at least 0.05 wt. % and no more than 0.5 wt. %;

pulverizing the alloy powder with the lubricant to produce a fine grain powder having an average particle size between 2.0 μm and 3.0 μm;

said step of pulverizing the alloy powder being further defined as jet milling the alloy powder to produce the fine grain powder;

mixing the fine grain powder with a lubricant, after said step of jet milling, having a weight content of at least 0.03 wt. % and no greater than 0.2 wt. %;

molding the fine grain powder into a compact;

said step of molding further including a step of orienting the fine grain powder under a magnetic field of between 2.0 T and 2.5 T;

sintering the compact at a sintering temperature of between 880° C. and 1030° C. under a vacuum of no more than $5\times10^{-2}$ Pa for a first time extent of between 6 hours and 15 hours to produce a magnet; and controlling oxygen content during said step of melting, said step of forming, said step of disintegrating, said step of mixing, said step of pulverizing, and said step of molding and said step of sintering whereby the impurities including the Carbon (C) and the Oxygen (O) and the Nitrogen (N) satisfies 1.2C+0.6O+N≤2800 ppm;

said step of sintering further including steps of:

cooling the compact to room temperature;

heating the compact from the room temperature to a first annealing temperature of between 780° C. and 860° C.;

maintaining the compact at the first annealing temperature of between 780° C. and 860° C. for a second time extent of 3 hours and under the vacuum of no more than $5\times10^{-2}$ Pa;

cooling the compact from the first annealing temperature to the room temperature;

heating the compact from the room temperature to a second annealing temperature of between 480° C. and 550° C.;

maintaining the compact at the second annealing temperature for a third time extent of between 2 hours and 8 hours and under the vacuum of no more than $5\times10^{-2}$ Pa.

2. The method as set forth in claim 1 wherein said step of jet milling is further defined as jet milling the alloy powder with the lubricant using a carrier gas of argon to produce the fine grain powder.

3. The method as set forth in claim 1 wherein said step of jet milling is further defined as jet milling the alloy powder with the lubricant using a carrier gas of nitrogen to produce the fine grain powder.

4. The method as set forth in claim 1 wherein said step of forming being further defined as thin strip casting the raw powder to form the alloy sheet having a uniform thickness of between 0.1 mm to 0.6 mm.

5. The method as set forth in claim 1 wherein said step of disintegrating is further defined as subjecting the alloy sheet in the hydrogen atmosphere in a hydrogen decrepitation process under a predetermined pressure of between 0.15 MPa and 0.3 MPa for a duration of 3.5 hours.

6. The method as set forth in claim 1 wherein said step of degassing the hydrogen is further defined as removing the hydrogen at a predetermined temperature of 550° C.

* * * * *